US008058573B2

(12) United States Patent
Tang et al.

(10) Patent No.: US 8,058,573 B2
(45) Date of Patent: Nov. 15, 2011

(54) ELECTRONIC APPARATUS WITH PRESS PANEL

(75) Inventors: Gao-Hui Tang, Shenzhen (CN); Yong-Qing Zeng, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 355 days.

(21) Appl. No.: 12/399,034

(22) Filed: Mar. 6, 2009

(65) Prior Publication Data

US 2009/0301856 A1 Dec. 10, 2009

(30) Foreign Application Priority Data

Jun. 4, 2008 (CN) ..... 2008 1 0301969

(51) Int. Cl.
*H01H 9/00* (2006.01)

(52) U.S. Cl. ..... 200/5 R; 200/5 A; 200/512

(58) Field of Classification Search ..... 341/22, 341/27, 34; 345/168, 169, 173, 176; 455/351, 455/38.4, 90; 340/825.44; 200/5 R, 5 A, 200/511, 512, 341, 302.1, 302.2, 333, 310–317, 600

See application file for complete search history.

(56) References Cited

U.S. PATENT DOCUMENTS

| | | | | |
|---|---|---|---|---|
| 4,543,563 | A * | 9/1985 | Wine | 341/22 |
| 4,611,261 | A | 9/1986 | Suwa | |
| 5,408,057 | A * | 4/1995 | Hayes | 200/5 A |
| 5,822,690 | A * | 10/1998 | Rynk et al. | 455/351 |
| 6,067,074 | A * | 5/2000 | Lueders | 345/156 |
| 6,080,940 | A * | 6/2000 | Rice | 200/5 A |
| 7,606,483 | B2 * | 10/2009 | Kurosawa | 396/299 |
| 7,826,806 | B2 * | 11/2010 | Choi | 455/90.3 |
| 7,897,888 | B2 * | 3/2011 | Dimig | 200/302.2 |

FOREIGN PATENT DOCUMENTS

JP 10134671 A 5/1998

* cited by examiner

*Primary Examiner* — Michael Friedhofer
(74) *Attorney, Agent, or Firm* — Altis Law Group, Inc.

(57) ABSTRACT

An electronic apparatus comprises a main body, a front frame mounted on the main body, a transparent elastic press panel disposed between the main body and the front frame, a plurality of contacts beneath the elastic press panel, and a plurality of stop pieces disposed between the contacts respectively. The stop pieces divide the elastic press panel into portions corresponding to the contacts. Each portion of the elastic press panel can be pressed down independently for activating the corresponding contact.

4 Claims, 4 Drawing Sheets

ELECTRONIC APPARATUS WITH PRESS PANEL

BACKGROUND

1. Technical Field

The disclosure relates to electronic apparatuses and, particularly, relates to an electronic apparatus with a press panel.

2. General Background

Electronic apparatuses usually have input devices. There are two typical input devices: buttons and touch panels. The buttons have the benefit of providing tactile feedback when pressed, such as a clicking sensation, or an arresting of motion when the button has been pressed far enough. But the appearance of buttons on an electronic device is not very aesthetic. Whereas a touch panel blends in better and need not detract from the appearance of an electronic apparatus. However, a touch panel does not provide tactile feedback and may feel unsatisfactory to user as the user cannot be sure if an input operation has succeeded based on their sense of touch.

That's, what is needed is an electronic apparatus with an input device, the input device has an aesthetic appearance and providing tactile feedback when pressed.

BRIEF DESCRIPTION OF THE DRAWINGS

The elements in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
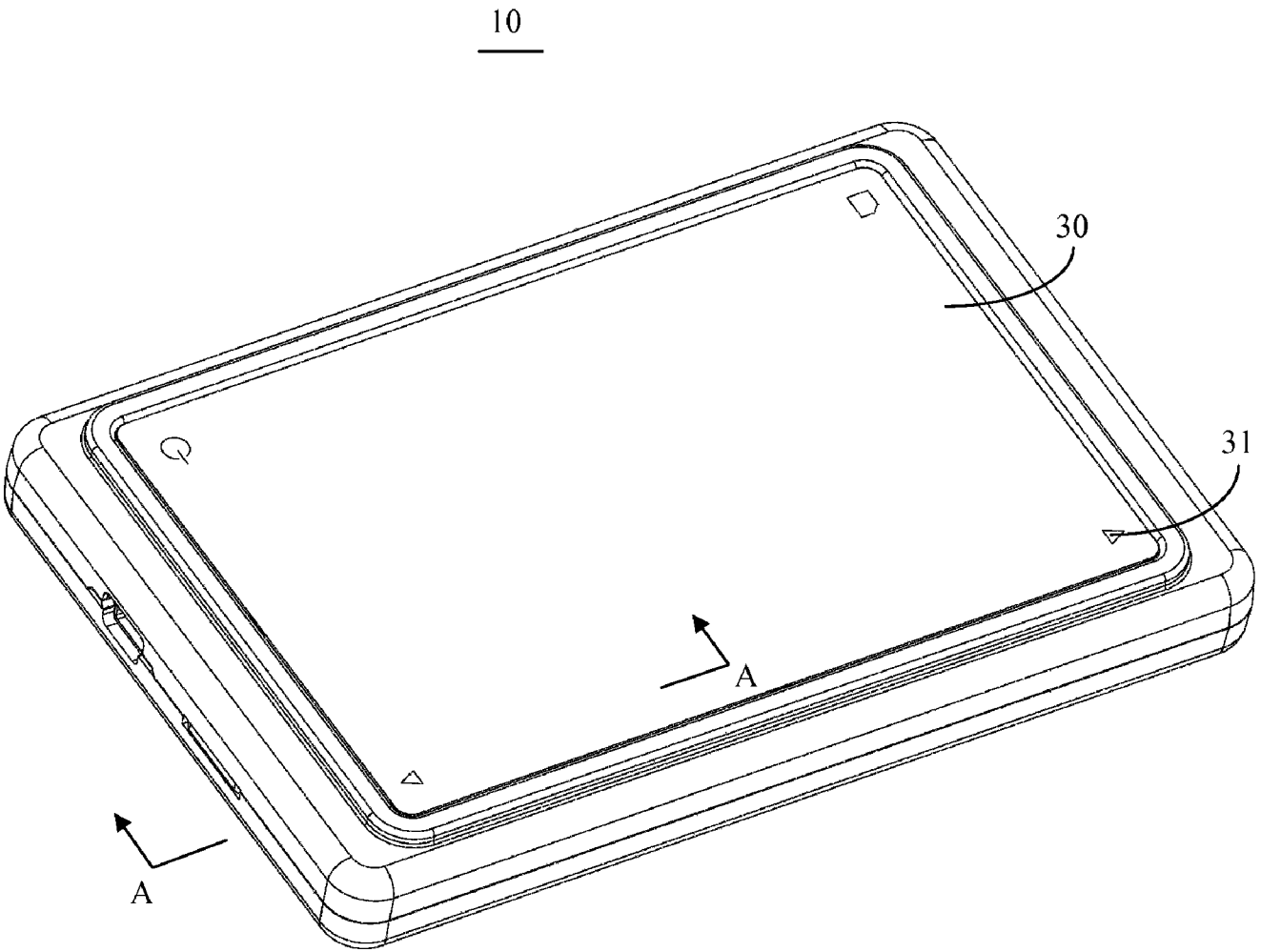
FIG. 1 is a schematic, isometric view of an electronic apparatus according to an exemplary embodiment.

Referring to FIG. 1, an electronic apparatus 10 is disclosed. In the exemplary embodiment, the electronic apparatus 10 is a polygon-shaped digital photo frame.

Figure 2:
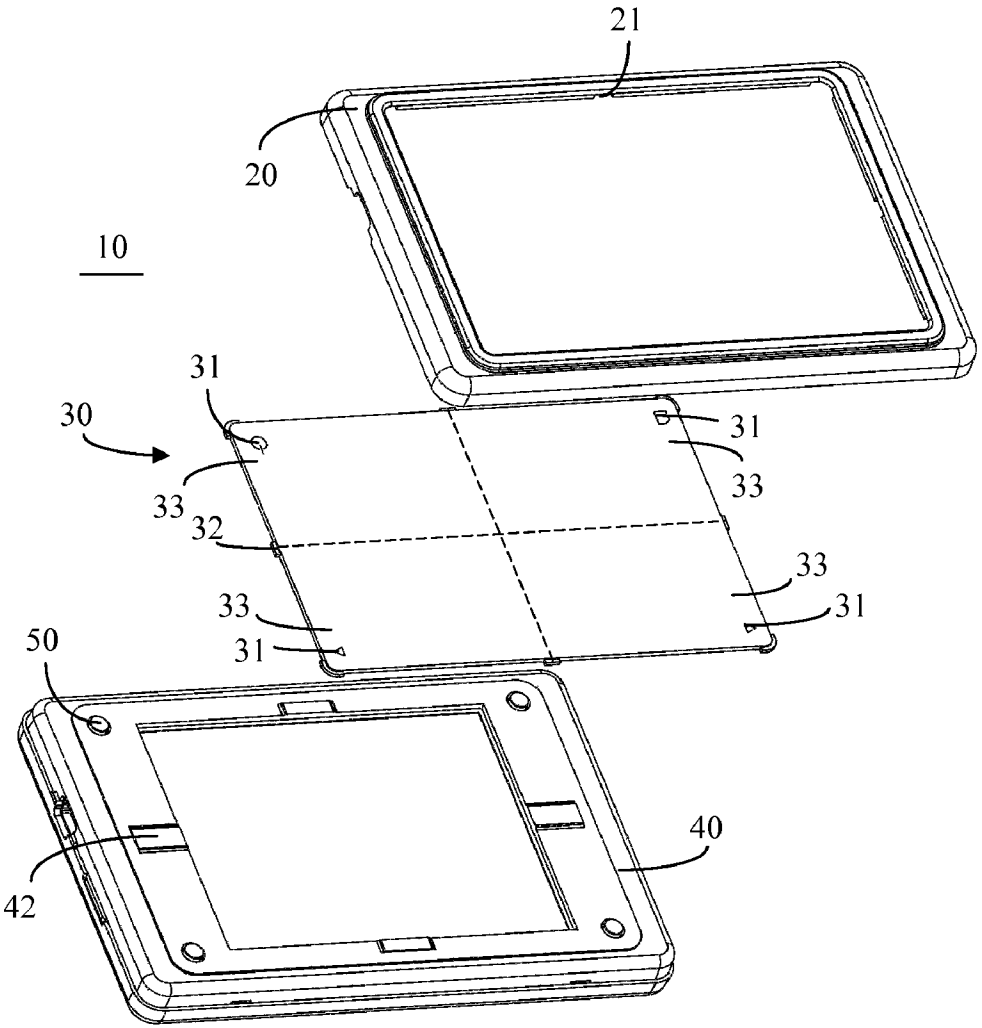
FIG. 2 is an exploded view of the electronic apparatus of FIG. 1.
Figure 3:
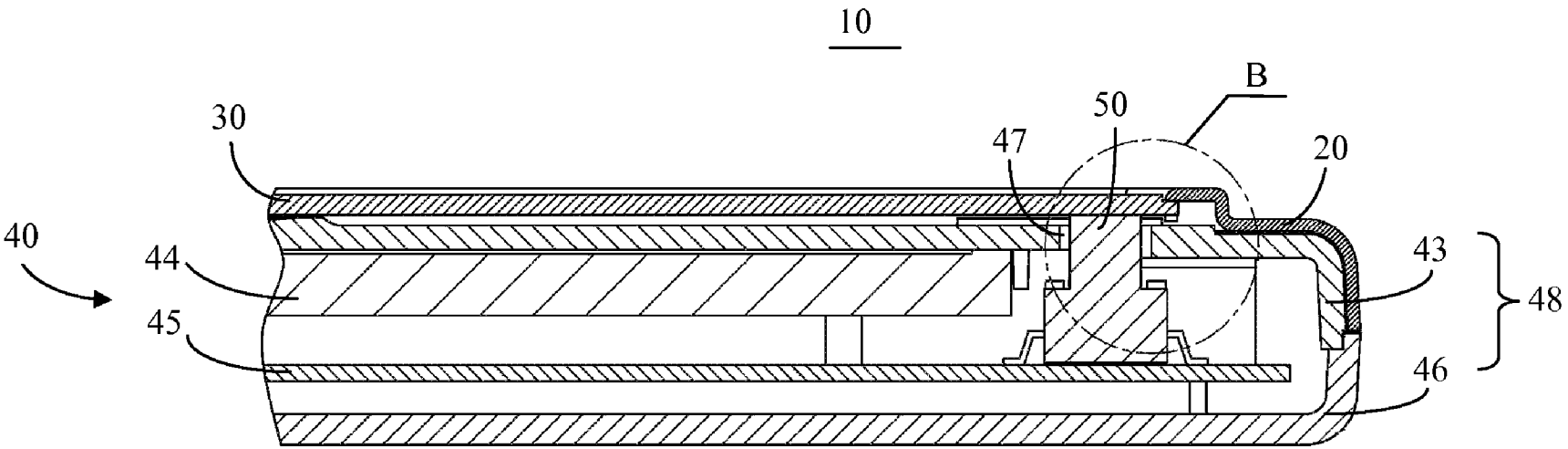
FIG. 3 is a section view of the electronic apparatus along the A-A line in FIG. 1.
Figure 4:
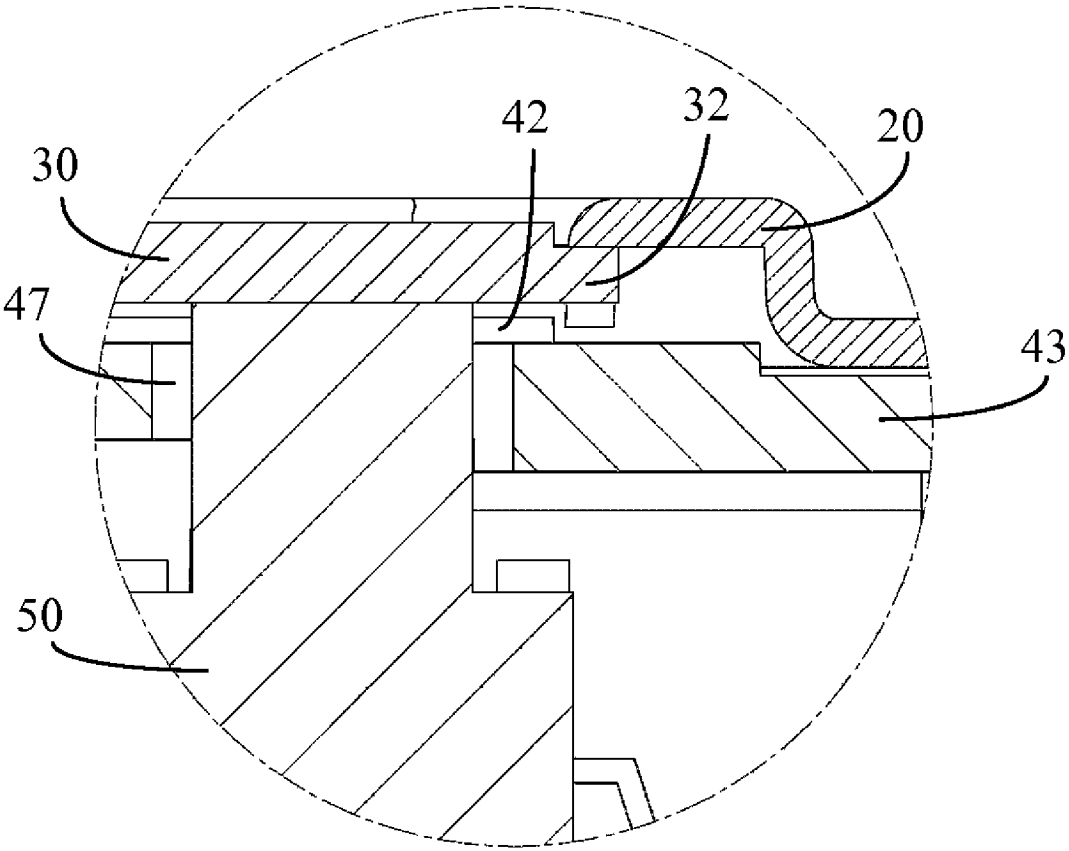
FIG. 4 is an enlarged view of the B portion of the electronic apparatus of FIG. 3.

Referring to FIGS. 2, 3 and 4, the digital photo frame 10 includes a main body 40, a front frame 20, and an elastic press panel 30.

The main body 40 includes an enclosure 48, a display panel 44, a PCB (printed circuit board) 45, and other electronic components (not shown). The enclosure 48 is configured to receive the display panel 44, the PCB 45, and the electronic components. The enclosure 48 includes a front cover 43 and a back cover 46. A plurality of contacts 50 is disposed on the PCB 45. The contacts 50 extend through holes 47 defined in the front cover 43, to the contacts 50 project out from the front cover 43.

The elastic press panel 30 is transparent, polygon-shaped, and in this embodiment is made from polymethyl methacrylate (PMMA). The elastic press panel 30 includes signs 31 disposed on the corners thereof for indicating positions and functions of the contacts 50. The elastic press panel 30 includes protrusions 32 peripherally projected therefrom. The front frame 20 defines notches 21 for receiving the protrusions 32. The front frame 20 receives the elastic press panel 30 and limits the movement of the elastic press panel 30 by interlocking with the protrusions 32 and the notches 21. The front frame 20 further connects to the main body 40. In this way, the elastic press panel 30 is disposed between the front cover 43 and the main body 40.

The digital photo frame 10 further includes a plurality of stop pieces 42. In this embodiment, the stop pieces 42 are projections extended from the front cover 43. The stop pieces 42 are disposed between contacts 50 and divide the elastic press panel 30 into a plurality of portions 33 corresponding to the contacts 50. Each portion 33 of the elastic press panel 30 can be pressed down independently to actuate the corresponding contact 50. The stop pieces 42 prevent the other portions 33 of the elastic press panel 30 to move down when a portion 33 of the elastic press panel 30 is pressed down. Thus an aesthetic panel is provided as an input device but still provides tactile feedback as traditional buttons would.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. An electronic apparatus comprising:

a main body, comprising:

an enclosure configured to receive a display panel and a printed circuit board, the enclosure comprising a front cover and a back cover, the front cover defining holes;

a front frame mounted on the main body;

a transparent elastic press panel disposed between the main body and the front frame;

a plurality of contacts beneath the elastic press panel, the contacts extending through the holes defined in the front cover to project out from the front cover; and a plurality of stop pieces, the stop pieces being projections extended from a surface of the front cover of the main body, and disposed between the contacts respectively for dividing the elastic press panel into portions corresponding to the contacts, wherein each portion of the elastic press panel is able to be pressed down independently for activating the corresponding contact.

2. The electronic device of claim 1, wherein the elastic press panel is polygon-shaped, and the contacts are disposed beneath corners of the elastic press panel.

3. The electronic device of claim 1, further comprising a plurality of signs, wherein the signs are disposed on the edges of the elastic press panel and are configured for indicating positions and functions of the contacts.

4. The electronic device of claim 1, wherein the elastic press panel comprises protrusions peripherally extended therefrom, and the front frame defines notches for receiving the protrusions.

* * * * *